United States Patent [19]

Dietz

[11] Patent Number: 4,961,965

[45] Date of Patent: Oct. 9, 1990

[54] METHOD AND APPARATUS FOR AUTOMATED DISPENSING OF LIQUID MATERIALS ONTO A WORKPIECE

[75] Inventor: Mark P. Dietz, St. Paul, Minn.

[73] Assignee: Minnesota Mining and Manufacturing Company, St. Paul, Minn.

[21] Appl. No.: 374,098

[22] Filed: Jun. 29, 1989

[51] Int. Cl.[5] ..... B05D 5/10; B05C 3/20

[52] U.S. Cl. ..... 427/286; 427/207.1; 118/410; 118/415; 118/697

[58] Field of Search ..... 427/286, 207.1; 118/410, 415, 697

[56] References Cited

U.S. PATENT DOCUMENTS

| | | | |
|---|---|---|---|
| 1,249,038 | 12/1917 | Dabney | 138/110 |
| 1,977,775 | 10/1934 | Patterson | 138/110 |
| 2,069,256 | 2/1937 | MacKenzie | 118/410 |
| 2,270,463 | 1/1942 | Nash | 118/410 |
| 2,619,125 | 11/1952 | Eickmeyer et al. | 138/110 |
| 2,640,502 | 6/1953 | Powers | 285/114 |
| 3,610,289 | 10/1971 | Moss | 138/90 |
| 4,692,351 | 9/1987 | Maeda et al. | 427/286 X |
| 4,697,501 | 10/1987 | Hupf | 99/279 |

OTHER PUBLICATIONS

"EFD Quality Dispensing Components," brochure from EFD, Providence, RI (Undated).

"Roean Industries . . . The Benchmark," brochure from Roean Industries, Inc., Pacoima, CA (Undated).

Reprinted Article from Production Engineeering, Jan. 1986, "Programmed Motion Automates Dispensing."

"Otto A9t," brochure from Otto Equipment, Carpentersville, IL, 1987.

*Primary Examiner*—Evan Lawrence

*Attorney, Agent, or Firm*—Donald M. Sell; Walter N. Kirn; James D. Christoff

[57] ABSTRACT

A method and apparatus for automated dispensing of liquid materials onto a workpiece. The automated dispensing apparatus has a nozzle assembly which includes a flexible tube that is surrounded by a coil spring. The apparatus may be programmed to slide the nozzle assembly along a surface of a workpiece as liquid materials are discharged from the tube. The spring prevents kinking of the tube and protects the tube from abrasive damage, and also biases the lower end of the tube toward a position in contact with the workpiece.

8 Claims, 1 Drawing Sheet

METHOD AND APPARATUS FOR AUTOMATED DISPENSING OF LIQUID MATERIALS ONTO A WORKPIECE

BACKGROUND OF THE INVENTION

1. Field of the Invention

This invention relates to a method and apparatus for automated dispensing of liquid materials through a flexible nozzle in contact with a workpiece.

2. Description of the Related Art

Automated dispensing of liquid materials such as adhesives, coatings, sealers and the like onto a workpiece may be accomplished by a three-axis programmable dispensing system having a movable arm and a needle carried by the arm for discharging liquid materials onto a workpiece. Systems of this type are often programmed to discharge the liquid materials along a straight or curved path at one or more locations on the workpiece. Microcomputer controlled stepper motors or linear motor drives provide precise control for the arm so that the needle can be accurately moved and positioned.

The needle of many conventional dispensing systems is made from an elongated, rigid, metal tube and has an outlet at one end thereof for discharging the liquid materials. However, if the needle contacts a portion of the workpiece or a support carrying the workpiece, the needle may bend or kink. As a consequence, much effort has been directed in the past to carefully program the microcomputer controlling the movement of the arm so that the outlet of the needle is always spaced a slight distance from the workpiece and contact with the workpiece or the support is avoided. The programming task becomes somewhat complex if, for instance, the workpiece is formed with a number of irregular, contoured or curved surfaces.

Other needles used in automated dispensing systems are made from a plastic such as Teflon or polypropylene in order to avoid a reaction between the needle and certain materials being dispensed. Although plastic needles are somewhat flexible, such needles tend to become limp when hot and may curl when cool, and as a result the outlet of the needle may miss its intended location as the needle moves along its programmed path. In addition, the plastic needle may kink if bent excessively which may interrupt further dispensing of the materials. In some instances, a rigid metal sleeve has been provided to surround the plastic needle along an upper portion of its length, but the sleeve may be permanently deformed if the sleeve unintentionally contacts the workpiece or the support for the workpiece.

SUMMARY OF THE INVENTION

The present invention provides a method and apparatus for automated dispensing of liquid materials onto a workpiece. The apparatus comprises a source of liquid materials along with a nozzle assembly having a flexible tube. The tube is connected to the source of liquid materials and has an outlet end for discharging liquid materials onto a workpiece. The assembly includes a spring which extends along the length of the tube and biases the outlet end of the tube toward a predetermined orientation. The apparatus also includes a support for holding a workpiece, and motive power means for moving the assembly relative to the support along a path such that at least a portion of the assembly adjacent the outlet end is in contact with the workpiece as liquid materials are discharged onto the workpiece.

Consequently, the nozzle assembly is not normally damaged upon coming into intentional or unintentional contact with the workpiece and dispensing of liquid materials is not impeded. As one example, liquid materials may be discharged through the tube as the nozzle assembly slides along a surface of the workpiece. As another example, the nozzle assembly may safely come into head-on contact with a wall of the workpiece without kinking as the assembly moves along an intended path before changing directions. The nozzle assembly is flexible and does not normally damage the workpiece that is contacted.

DETAILED DESCRIPTION OF THE DRAWINGS

Figure 1:
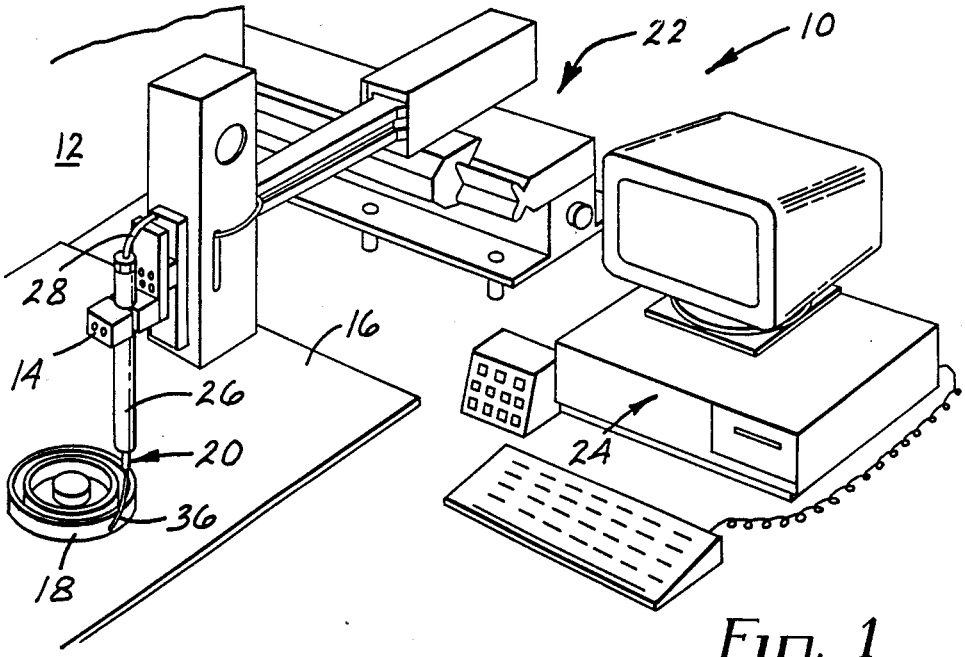
FIG. 1 is a perspective view of the present invention, and illustrates a nozzle assembly discharging liquid materials onto a curved perimeter of a workpiece.

Referring initially to FIG. 1, an automated dispensing apparatus 10 broadly includes a frame 12, an arm 14 movably connected to the frame 12, and a support 16 fixed to the frame 12 for holding a workpiece 18. The arm 14 carries a nozzle assembly 20 for dispensing liquid materials onto the workpiece 18.

The apparatus 10 includes a motive power means 22 with three motor drives for moving the arm 14 in X, Y or Z axis directions. A microcomputer controller 24 connected the motive power means 22 may be programmed to move the arm 14 along a predetermined curved or straight path relative to the workpiece 18. An exemplary programmable X-Y-Z material dispenser which may be used for moving the nozzle assembly 20 is the 3M A9t automatic dispenser, available from the assignee of the present invention.

The nozzle assembly 20 is connected to a source of liquid materials 26 which is also carried by the arm 14. The source 26 is adapted to contain a quantity of materials such as adhesives, coatings, sealers and the like. An upper end of the source 26 has an inlet pipe that is connected by a flexible hose 28 to a supply of air pressure controlled by the microcomputer controller 24.

Figure 2:
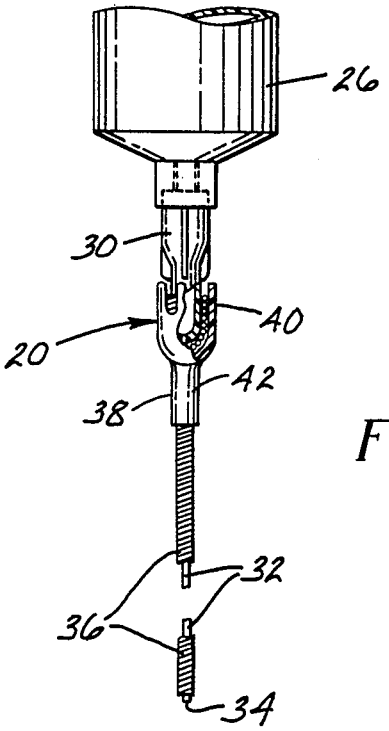
FIG. 2 is an enlarged elevational view with parts broken away in section of the nozzle assembly shown in FIG. 1.

The nozzle assembly 20 is shown in more detail in FIG. 2 and includes a collar 30 that detachably fits onto an outlet pipe of the source 26. An elongated, flexible, polyethylene tube 32 is secured to the collar 30 and has a lowermost outlet end 34 and an internal passageway for directing liquid materials within the source 26 to the outlet 34.

An elongated, helical coil spring 36 of the assembly 20 extends along the length of the tube 32 and has an upper, open frusto-conical end which releasably fits onto a complementally-shaped lower end of the collar 30. The spring 36 biases the tube 32 toward a straight configuration and prevents kinking or collapse of the tube 32 during a dispensing operation. The lower end 34 of the tube 32 extends slightly below the lower end of the spring 36.

A plastic cap 38 has an upper concave section 40 which snaps over the mating, upper end of the spring 36 and which functions to retain the spring 36 on the collar 30. A lower cylindrical section 42 of the cap 38 is somewhat rigid and serves to prevent undue strain on the joint between the tube 32 and the collar 30.

As illustrated in FIG. 1, the microcomputer controller 24 may be programmed to cause the motive power means 22 to move the arm 14 along a path such that a lower portion of the nozzle assembly 20, and in particular the lower portion of the spring 36 adjacent the outlet end 34, is in sliding contact with the workpiece 18 as liquid materials are dispensed through the outlet end 34. The controller 24 controls air pressure to the source 26 so that liquid materials are dispensed, if desired, only during a selected portion of the time that the arm 14 and thereby the nozzle assembly 20 are moving along their intended paths of travel. The controller 24 may also be programmed to establish a negative air pressure in the source 26 at the end of a dispensing operation so that the liquid materials are pulled up and away from the outlet end 34.

As a consequence, relatively simple programs may be provided for the controller 24, since the nozzle assembly 20 is operable to dispense materials while in sliding contact with the workpiece 18 and the controller 24 need not be programmed to precisely hold the outlet end 34 a distance slightly spaced from the workpiece 18. The spring 36 prevents the tube 32 from kinking or collapsing so that the liquid materials continue to flow during the dispensing operation regardless of the linear extent of contact between the nozzle assembly 20 and the workpiece 18. The inherent bias of the spring 36 is useful for insuring that the outlet end 34 or the lowermost portion of spring 36 remains in contact with the workpiece 18.

Good results are also observed, however, when the assembly 20 of the present invention is moving in a straight path and comes into contact with a blocking projection of the workpiece or support before a change in direction of the assembly 20 is carried out by the arm 14. This latter aspect is especially useful on certain automated dispensers wherein the arm can drift somewhat from its intended location.

Further, the metallic spring 36 prevents abrasive damage to the substantial length of the tube 32 even after repeated contact with the workpiece. If, for some reason, the tube 36 becomes clogged, the spring 36 may be removed and used with another tube and collar assembly.

The spring 36 may also have a normally curved or U-shaped configuration instead of normally straight configuration shown in FIGS. 1 and 2. As one example, a U-shaped configuration is useful for holding the tube 32 in a similar configuration and dispensing adhesive onto the underside of a workpiece.

We claim:

1. Apparatus for automated dispensing of liquid materials onto a workpiece comprising:

a source of liquid materials;

a nozzle assembly including a flexible tube connected to said source of liquid materials and having an outlet end for discharging liquid materials onto a workpiece, said assembly including a spring extending along the length of said tube for biasing said outlet end of said tube toward a predetermined orientation;

a support for holding the workpiece; and motive power means for moving said assembly relative to said support along a path such that at least a portion of said assembly adjacent said outlet end is in contact with the workpiece as said liquid materials are discharged onto the workpiece.

2. The apparatus of claim 1, wherein said spring comprises a coil spring surrounding said tube.

3. The apparatus of claim 2, wherein said nozzle assembly includes a collar connected to said flexible tube, and wherein said spring has an upper end releasably connected to said collar.

4. The apparatus of claim 3, wherein said upper end of said spring has a concave configuration.

5. The apparatus of claim 1, wherein said motive power means is operable to move said assembly relative to said support along a path such that said portion of said assembly is in sliding contact with the workpiece.

6. The apparatus of claim 1; and including a controller for controlling said motive power means for moving said assembly along X, Y and Z axes.

7. A method for automated dispensing of liquid materials onto a workpiece comprising the steps of:

discharging a quantity of liquid materials through an outlet end of a flexible tube of a nozzle assembly;

biasing said tube toward a predetermined orientation by a spring of said assembly, said spring extending along the length of said tube; and moving said assembly relative to a workpiece along a path such that at least a portion of said assembly adjacent said outlet end is in contact with the workpiece as the materials are discharged.

8. The method of claim 7, wherein said step to moving said assembly is carried out such that said portion of said assembly is in sliding contact with the workpiece.

* * * * *